United States Patent [19]

Langhammer et al.

[11] 4,042,223

[45] Aug. 16, 1977

[54] ARRANGEMENT FOR AND A METHOD OF INTRODUCING PARTICULATE MATERIAL INTO MOLTEN BATHS

[75] Inventors: Hans Jürgen Langhammer, Platjenwerbe; Horst Abratis, Hagen; Klaus Schäfer, Georgsmarienhütte; Klaus-Jürgen Rendel, Georgsmarienhutte; Horst Lotze, Georgsmarienhutte, all of Germany

[73] Assignee: Klockner-Werke AG, Duisburg, Germany

[21] Appl. No.: 699,640

[22] Filed: June 24, 1976

[30] Foreign Application Priority Data

June 27, 1975 Germany ..... 2528672

[51] Int. Cl.[2] ..... C21C 7/00

[52] U.S. Cl. ..... 266/47; 266/217; 266/225

[58] Field of Search ..... 266/216, 217, 225, 226

[56] References Cited

U.S. PATENT DOCUMENTS

| | | | |
|---|---|---|---|
| 905,948 | 12/1908 | Stromborg | 266/217 |
| 2,805,147 | 9/1957 | Schreiber | 266/217 |
| 2,858,125 | 10/1958 | Clenny et al. | 266/216 |
| 2,893,716 | 7/1959 | Smith | 266/216 |
| 3,365,242 | 1/1968 | Marchetti | 266/225 |

FOREIGN PATENT DOCUMENTS

| | | | |
|---|---|---|---|
| 81 of | 1870 | United Kingdom | 266/225 |

*Primary Examiner*—Gerald A. Dost
*Attorney, Agent, or Firm*—Michael J. Striker

[57] ABSTRACT

A suspension of a particulate material in a carrier medium is introduced into a molten bath through a lance which has an inlet port, an outlet port and a passage communicating the inlet port with the outlet port. The flow-through cross-sectional area of the outlet port is smaller than the flow-through cross-sectional area of the passage so that the speed of flow of the suspension through the outlet port is higher than the speed of flow of the suspension through the passage and penetration of the molten bath into the outlet port is thereby prevented. The supension is introduced into the inlet port through a conduit having a smaller flow-through cross-sectional area than the passage so that the pulsations of the solution which occur in the conduit are damped in the passage. A duct may introduce pressurized medium into the region of the outlet port to thereby loosen the particulate material accumulated in the region of the outlet port. The lance may include a metallic tube and a lyer of refractory material surrounding the same, and a ceramic tubular element may form a continuation of the metallic tube downstream of the outlet port and having the same flow-through cross-sectional area as the latter.

19 Claims, 2 Drawing Figures

2
6
12
13
1
14
10
3
5
7

3
10
5
11
4
9
8
7

ARRANGEMENT FOR AND A METHOD OF INTRODUCING PARTICULATE MATERIAL INTO MOLTEN BATHS

BACKGROUND OF THE INVENTION

The present invention relates to an arrangement for introducing particulate materials into molten baths, and to a corresponding method.

There are already known various arrangements for introducing particulate materials into molten baths, among them such in which the particulate material is introduced into the molten bath in suspension in a carrier medium, particularly gaseous carrier medium, through a lance which is partially immersed into the molten bath and provided with a refractory layer at least in the region of such immersion.

The purpose of such conventional arrangements is to introduce particulate materials as deep as possible below the upper surface of the molten bath so that desired reactions between the particulate material and the material of the molten bath can take place during the ascent of the particulate material toward the upper surface of the molten bath. Under ordinary circumstances, a molten metallic material included in the molten bath, such as molten steel, is to be desulfurized, deoxidized or alloyed in this manner. Usually, the particulate materials which are to be introduced into the bath of molten metal have a specific weight which is lower than that of the metallic material contained in the bath, so that the particulate material rather rapidly ascends to the upper surface of the molten bath. It will be appreciated that the desired chemical reactions between the particulate material and the material of the molten metallic bath can take place only during the time that the particulate material ascends to the upper surface of the metallic bath.

In this manner, the metallic material of the molten bath can be desulfurized using, for instance, finely pulverized lime, calcium carbide or magnesium. On the other hand, carbonaceous material, aluminum and other metals which have high affinity toward oxygen can be used for deoxidizing the metallic bath. Finally, such metals can be alloyed with the material of the metallic bath for which it is difficult to obtain proper metallic solution either because of the low specific weight of the alloying metal or the high affinity of such alloying metal toward oxygen. What is common to the materials to be introduced into the molten bath, of which some examples have been mentioned previously, is that they ascend to the upper surface of the metallic bath after their introduction into the bath and, respectively, have an affinity or absorption capacity toward sulfur or oxygen or have to be protected from the influence of the surrounding atmosphere and/or of the slag when they are to be used as alloying metals.

On the other hand, the behavior of such particulate materials within the molten metallic bath is considerably different. So, for instance, finely powdered lime remains chemically unchanged during its ascent through the molten metallic bath, except for the desired external deposition of sulfur on the particles of lime. On the other hand, calcium carbide decomposes, while the introduced metals dissolve, melt or even evaporate. The purpose of such treatment is, in any event, to obtain an intimate contact of the introduced particulate material with the material of the molten metallic bath which is to be treated during the ascent of the particulate material.

Such intimate contact is preferably obtained by the introduction of the particulate material as deep underneath the upper surface of the molten bath as possible. However, this possibility is limited by natural circumstances, such as the dimensions of the container in which the molten bath is to be contained and treated, or the usable depth of collecting or transporting containers. A further possiblitity is to extend the period of treatment of the material of the molten metallic bath to an extent permitted by the operating requirements of the melting bath. Thus, it is already known to introduce the particulate material into the molten metallic bath over a period of 10 to 15 minutes, the introduction consisting of uniformly introducing relatively small amounts of the respective particulate material into the metallic bath.

It is relatively uncomplicated to pneumatically convey large amounts of particulate material even over large distances. However, it is rather difficult to convey relatively small amounts of particulate material which, necessarily, involves use of relatively small amounts of the gaseous carrier medium which entrains the relatively small amount of the particulate material. When thrust conveying, that is conveying of large particles of a solid material using a minimum amount of carrier medium, is resorted to, a pulsation of the advancing stream is principally unavoidable. As a result of such a pulsation, the flow-through cross-sectional area of the outlet opening through which the particulate material is to be introduced into the metallic bath may become closed or clogged which, of course, results in a deterioration of the introduction of the particulate material into the molten bath.

An arrangement which to some extent alleviates the above-mentioned problem is disclosed in a U.S. Pat. No. 3,891,196 in which the pressure variations are controlled by means of an additional bypass conduit and in which the receptacle for a supply of the particulate material to be introduced into the molten metallic bath is located as close as possible to the outlet port of an arrangement for introducing the particulate material into the molten bath. However, this construction has certain disadvantages. First of all, this arrangement must be so constructed that the entire receptacle for the particulate material will follow the lifting and lowering movement of the immersible lance. Further disadvantages of this arrangement are the difficult access to the various parts of the arrangement, and the fact that the storage receptacle and the associated parts are exposed to the influence of the heat which emanates from the molten bath above which the storage receptacle is located. Furthermore, it is very difficult to control the amount of the particulate material which is introduced into the molten bath using usual weighing or measuring apparatus, and a relatively high pressure of the carrier medium is necessary for forwarding the particulate material through the conduit which has a constant cross section.

SUMMARY OF THE INVENTION

Accordingly, it is a general object of the present invention to avoid the disadvantages of the prior-art arrangements for introducing particulate material into a molten bath.

More specifically, it is an object of the present invention to provide an arrangement for introducing particulate material into a molten bath in which clogging of the outlet opening of an immersible lance is avoided.

A further object of the present invention is to provide an arrangement of the type here under consideration in which the particulate material is faultlessly introduced into the molten bath.

A concomitant object of the present invention is to provide an arrangement which renders it possible to convey the particulate material over substantial distances and introduce it into the molten bath in a reliable manner.

A yet another object of the present invention is to provide an arrangement for introducing the particulate material into a molten metallic bath, which is simple in construction and reliable in operation.

Still another object of the present invention is to devise a method for introducing particulate material into a molten bath which avoids the disadvantages of the prior-art methods.

In pursuance of these objects and others which will become apparent hereafter, one feature of the present invention resides, briefly stated, in an arrangement for introducing particulate material into molten baths, in a combination comprising means for containing a molten bath; a source of a suspension of a particulate material in a carrier medium; means for conveying the suspension from the source toward the containing means; and an elongated lance which is partially immersed in the molten bath and which has an inlet port communicating with the conveying means outside of the molten bath, an outlet port longitudinally spaced from the inlet port, having a first flow-through cross-sectional area and communicating with the molten bath, and a passage which communicates the inlet port with the outlet port and has a second flow-through cross-sectional area which is larger than the first area.

Preferably, the above-mentioned passage is elongated and extends over most of the length of the lance, the lance further having a conically configurated passage portion intermediate the passage and the outlet port and steplessly merging therewith. The passage portion may have a conicity between 5° and 45°, and preferably between 5° and 10°. The conveying means may include a conduit which communicates with the inlet port and has a third flow-through cross-sectional area which is smaller than the second flow-through cross-sectional area. The second area may be between 3 to 5 times the third area, and the first area may be between one-third to one-tenth of the third area.

As a result of this arrangement, it is achieved that an accumulation of the particulate material in the region of the outlet is avoided, whereby clogging of the outlet port by the particulate material is prevented. The conical passage portion which is located upstream of the outlet port as viewed in the direction of movement of the suspension through the interior of the lance defines a compression zone in which the pulsations of the stream of the suspension are attenuated. The attenuation of the pulsations is enhanced through the gaseous buffer function of the gaseous medium present in the relatively large flow-through cross-sectional area of the passage. This renders it possible to forward the particulate material or the suspension thereof in the carrier gaseous medium over substantial distances without considerable pressure losses. This means that the storage receptacle and the arrangement for entraining the particulate material in the stream of the carrier medium can be arranged at a distance from the lance and can be supported independently of the latter at such a location where it is advantageous and where easy access to the storage receptacle and associated components is possible. A further advantage of this arrangement is to be seen in the fact that the support for the immersible lance can be dimensioned so that it need only support the lance itself and not the storage container for the particulate material.

When the material which is to be introduced into the molten bath can only be fluidized with difficulty, or if the material has such properties that it easily forms agglomerations, it is further advantageous according to an additional concept of the present invention to accommodate a pressurized medium duct within the confines of the lance and particularly inside the passage, the duct having an open end which is located in the region of the outlet port, and to introduce pressurized medium into the duct which pressuirzed medium then avoids clogging of the outlet port or of the conically converging passage portion by additionally fluidizing the particulate material which may accumulate in such regions of the interior of the lance.

In a currently preferred embodiment of the present invention, the flow-through cross-sectional area of the passage all the way to the conical passage portion can be 4 to 5 times larger than the flow-through cross-sectional area of the conduit which is connected to the immersible lance and communicates with the inlet port thereof, while the flow-through cross-sectional area of the outlet port of the immersible lance amounts to one-third to one-tenth of the flow-through cross-sectional area of the conduit.

In view of the fact that it is further possible that the outlet port of the immersible lance become clogged as a result of the size of the outlet port, it is further advantageous when the magnitude $y$ of the outlet port of the lance when expressed in $cm^2$ is selected in accordance with the equation $y = a \cdot x$ in which the amount of the particulate material to be conveyed in kg/min is designated as $x$, and in which $a$ is a coefficient amounting to 0.025 to 0.015 $cm^2 \cdot min/kg$.

In this manner, it is achieved that within the time period available for treating the metallic molten bath, especially a steel bath, which amounts to about 10 min, the amount of the particulate material which is needed for treating the material of the bath can be introduced into the metallic bath, while the introduction of the particulate material into the metallic bath occurs at such a speed that the desired reaction between the introduced particulate material and the molten bath is achieved. On the other hand, the size of the outlet port assures that no flowable steel will penetrate into the interior of the lance during the conveyance of the desired amount of the particulate material into the molten bath, and that such molten steel will not clog the outlet opening.

According to a further aspect of the present invention, the lance may include a metallic tube which bounds the passage and the inlet and outlet ports, and a layer of refractory material may then surround the metallic tube. In this embodiment, the lance further comprises wall means which forms an extension of the metallic tube at the outlet port and bounding an opening which has the same area as the outlet port and which communicates with the latter and with the molten bath. The wall means may be of a ceramic material.

A particular advantage of this arrangement is that the ceramic wall means prevents formation of metallic deposits in the region of the free end of the lance in the vicinity of the outlet port, which deposits would otherwise occur as a result of the cooling attendant to the expansion of the carrier gaseous medium upon passage thereof through the outlet port, or through the heat coveyance through the metallic tube which bounds the passage and inlet and outlet ports, if the metallic tube reached all the way to the exit of the gaseous suspension into the metallic molten bath. Therefore, it is advantageous if the metallic tube ends short of the free end of the lance, and when a ceramic tube or element forms an extension of the metallic tube from the end thereof toward the free end of the lance. In a currently preferred embodiment of this concept of the present invention, the metallic tube is formed with an annular recess at its free end portion, and the tubular element has an annular shoulder which is received within the annular recess of the metallic tube. Preferably, the ceramic tubular element is embedded in a body of refractory material which contains a high proportion of clay in order to assure gas-tightness of the arrangement.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DETAILED DISCUSSION OF THE PREFERRED EMBODIMENTS

Figure 1:
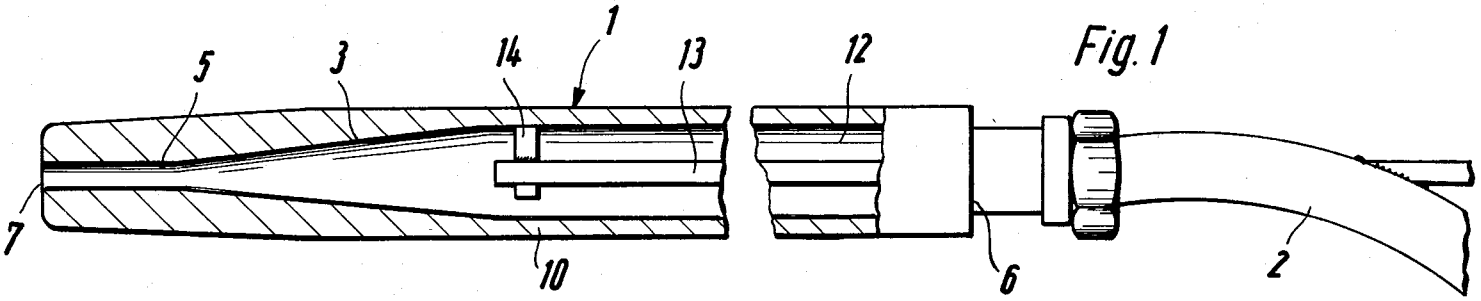
FIG. 1 is a partially sectioned side elevational view of a lance used in the arrangement of the present invention, a refractory jacket being omitted therefrom.

Referring now to the drawings in detail, and first to FIG. 1 thereof, it may be seen that an immersible lance has been designated in toto with a reference numeral 1. A conduit 2 is attached to the lance 1, such conduit 2 communicating the interior of the lance 1 with a conventional, non-illustrated storage receptacle for the particulate material. A stream of suspension of particulate material in a gaseous carrier medium is forwarded by the conduit 2 from the storage receptacle to the immersible lance 1.

Figure 2:
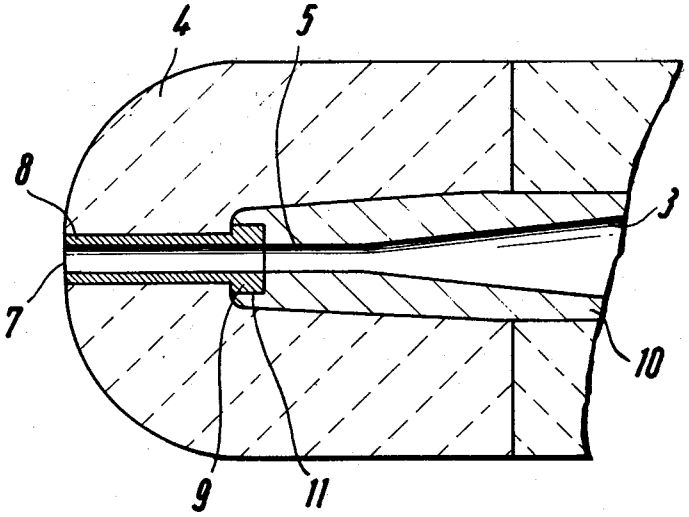
FIG. 2 is a sectional view of an end portion of a modified lance.

The immersible lance 1 includes a metallic, particularly steel, tube 10 which has, over the most of the length thereof, an inner diameter which is greater than the inner diameter of the conduit 2. The metallic tube 10 defines a passage 12 which has such a greater diameter, the passage 12 commencing at an inlet port 6 of the immersible lance 1. The lance 1 has a free end 7, and an outlet port 5 is provided in the free end 7 of the metallic tube 10. The diameter of the outlet port 5 is smaller than the diameter of the conduit 2. The passage 12 and the outlet port 5 are connected with one another by means of a conically converging passage portion 3 which steplessly merges with the passage 12 and the outlet port 5. In order to achieve the lowest possible friction of the suspension with the walls, small cone angles are preferred for the passage portion 3. The immersible lance 1 is provided, at least in the region which is immersed into the bath of molten metal, with a jacket 4 which is illustrated in FIG. 2 but has been omitted from FIG. 1 for the sake of clarity. The jacket 4 may also be reinforced in a conventional manner.

Inasmuch as the lance 1, or the metallic tube 10 thereof, defines the relatively long passage 12 which has a greater diameter than the conduit 2, the pulsation of the stream of the suspension of the particulate material in the carrier medium, which may be present in the conduit 2, is attenuated and/or eliminated in such passage 12, whereby the particulate material is introduced into the molten bath through the outlet port 5 in *a,* for all intents and purposes, pulsation-free manner. In this manner, clogging of the outlet port 5 by steel penetrating into the latter is avoided.

While not illustrated, it is to be understood that the merger of the conduit 2 with the passage 12 may also be accomplished in a stepless manner, by providing a conically diverging passage portion similar to the passage portion 3 at the inlet port 6 of the lance 1 or the metallic tube 10 thereof.

If necessary in order to further fluidize the suspension of the particulate material in the carrier medium, a duct 13 may be accommodated within the interior of the metallic tube 10, which duct 13 has an open end communicating with the region of the conically coverging passage portion 3, which duct 13 may be supported in the passage 12 by means of a plurality of supports 14. Preferably, the duct 13 is accommodated within the metallic tube 10 coaxially therewith. The duct 13 passes through the conduit 2 and is connected with a non-illustrated conventional source of a gaseous medium.

Referring now to FIG. 2, which illustrates a modified embodiment of the present invention, it may be seen that in this embodiment the metallic tube 10 ends short of the end of the lance 1. In this embodiment, the end portion 7 of the metallic tube is formed with an annular recess 11, and a ceramic tubular element 8 has a shoulder region 9 wich is received within the recess 11. The ceramic tubular element 8 has the same inner diameter as the outlet port 5, forming an extension thereof toward the end face 15 of the lance 1. The ceramic tubular element 8 is embedded in a body of refractory material 4 which contains a large proportion of clay, the body forming the end of the lance 1.

As an example of a practical utilization of the concepts of the present invention, it is to be mentioned that, for instance, when the conduit 2 has an inner diameter of 2.54 cm, the diameter of the passage 12 up to the coincally converging passage portion 3 may preferably be approximately 6 cm and the diameter of the outlet port 5 may amount to approximately 1 cm, the overall length of the immersible lance 1 being 4.5 m.

It will be understood that each of the elements described above, or two or more together, may also find a useful application in other types of construction differing from the types described above.

While the invention has been illustrated and described as embodied in an arrangement for and a method of introducing particulate material into a molten bath, it is not intended to be limited to the details shown, since various modifications nd structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for introducing particulate materials into molten baths comprising, in combination, means for containing a molten bath; a source of a suspension of a particulate material in a carrier medium; means for conveying the suspension from said source toward said containing means; and an elongated lance partially immersed in the molten bath and including a metallic tube having an inlet port communicating with said conveying means outside of the molten bath, an outlet port longitudinally spaced from said inlet port, having a first flow-through cross-sectional area and communicating with the molten bath, an annular recess around said outlet port, and a passage communicating said inlet port with said outlet port and having a second flow-through cross-sectional area which is larger than said first area, said lance further including a layer of refractory material surrounding said metallic tube, and a discrete tubular element of ceramic material having an annular shoulder portion received in said annular recess of said metallic tube, said tubular element forming an extension of said metallic tube at said outlet port and bounding an opening having said first area and communicating with said outlet port and said molten bath.

2. A combination as defined in claim 1, wherein said conveying means includes a conduit communicating with said inlet port and having a third flow-through cross-sectional area; and wherein said second area is larger than said third area.

3. In an arrangement for introducing flowable media into molten baths, a combination comprising a source of a flowable medium; and an elongated lance partially immersible into a molten bath and including a metallic tube bounding a passage having an inlet port communicating with said source and an outlet port longitudinally spaced from said inlet port, said tube having an annular recess around said outlet port, said lance further including a layer of refractory material surrounding said tube, and a discrete tubular element of ceramic material having an annular shoulder portion received in said annular recess of said tube, said tubular element bounding an opening communicating with said outlet port of said tube and with the molten bath when said lance is immersed in the latter.

4. A combination as defined in claim 3 wherein said passage is elongated and extends over most of the length of said lance.

5. A combination as defined in claim 3, wherein said lance further has a conically configurated passage portion intermediate said passage and said outlet port and steplessly merging therewith.

6. A combination as defined in claim 5, wherein said passage portion has a conicity between 5° and 45°.

7. A combination as defined in claim 6, wherein said conicity is between 5 and 10°.

8. A combination as defined in claim 3, and further comprising a pressurized medium source; and duct means communicating with said pressurized medium source, partially received in said passage and having an open end located in the region of said outlet port.

9. An arrangement for introducing particulate materials into a molten bath accommodated in a container comprising, in combination, a source of a suspension of a particulate material in a carrier medium; means for conveying a stream of the suspension from said source toward a container accommodating a molten bath, including a conduit having a first flow-through cross-sectional area; and an elongated lance partially immersible into the molten bath and having an inlet port communicating with said conduit outside of the molten bath, an outlet port longitudinally spaced from said inlet port, having a second flow-through cross-sectional area and communicating with the molten bath when said lance is immersed therein, and means for suppressing pulsations in the stream of the stream of the suspension prior to issuance of the latter into the molten bath through said outlet port, including a passage within said lance communicatng said inlet port with said outlet port and having a third flow-through cross-sectional area exceeding said first and second areas, in which passage the advancing suspension forms a compressible buffer body which suppresses the pulsations of the stream entering said passage through said inlet port.

10. A combination as defined in claim 9, wherein said third area is between three to five times larger than said first area.

11. A combination as defined in claim 9, wherein said second area is between one-third and one-tenth of said first area.

12. A combination as defined in claim 9, wherein said second area is selected according to the equation $$y = a \cdot x,$$

wherein $y$ is the second area expressed in $cm^2$ $x$ is the amount of the particulate material to be introduced in a time unit, expressed in kg/min; and $a$ is a coefficient amounting to 0.025 to 0.015 $cm^2 \cdot$ min/kg.

13. A combination as defined in claim 9, wherein said lance includes a metallic tube bounding said passage and said ports, and a layer of refractory material surrounding said metallic tube.

14. A combination as defined in claim 13; said lance further comprising wall means forming an extension of said metallic tube at said outlet port and bounding an opening having said second area and communicating with said outlet port and the molten bath.

15. A combination as defined in claim 14, wherein said wall means is of a ceramic material.

16. A combination as defined in claim 15, wherein said wall means includes a discrete tubular element of the ceramic material.

17. A combination as defined in claim 16, wherein said lance further includes a body of refractory material around said outlet opening; and wherein said tubular element is embedded in said body.

18. A combination as defined in claim 17, wherein said material of said body includes a high proportion of clay.

19. A method of introducing particulate material into a molten bath, comprising the steps of forming a suspension of a particulate material in a carrier medium; conveying a stream of the suspension toward the molten bath at a first speed, during which conveying undesirable pulsations develop in the stream; introducing the suspension into the molten bath at a second speed; and suppressing the pulsations of the stream of the suspension prior to said introducing step, including reducing the speed of flow of the suspension between said conveying and introducing steps to a value below said first and second speed to thereby form in the advancing suspension a compressible buffer which suppresses the pulsations.

* * * * *